US005803881A

United States Patent [19]

Miller

[11] Patent Number: 5,803,881

[45] Date of Patent: Sep. 8, 1998

[54] ATHLETIC TRAINING BELT

[76] Inventor: Wendy Jo Miller, 9478 Jamestown St. NE., Blaine, Minn. 55449

[21] Appl. No.: 847,054

[22] Filed: May 1, 1997

[51] Int. Cl.[6] ..... A63B 21/02

[52] U.S. Cl. ..... 482/124; 482/74; 482/126

[58] Field of Search ..... 482/121, 124, 482/125, 123, 126, 74

[56] References Cited

U.S. PATENT DOCUMENTS

| | | | |
|---|---|---|---|
| 5,167,601 | 12/1992 | Frappier | 482/74 |
| 5,190,512 | 3/1993 | Curran | 482/124 |
| 5,362,295 | 11/1994 | Nurge | 482/124 |
| 5,647,827 | 7/1997 | Gutkowski et al. | 482/124 |

*Primary Examiner*—Lynne A. Reichard
*Attorney, Agent, or Firm*—D. L. Tschida

[57] ABSTRACT

A belt which mounts to the hips and thighs and includes a number of fasteners for selectively attaching one or more training bands. The fasteners are arrayed about the circumference of hip and thigh straps. Varying degrees of resistance to hip rotation are obtained upon selectively positioning appropriate elastic and/or static training bands to the fasteners at the front, sides and rear of the hip strap. The training bands may be supported to stationary objects or handles can be gripped by a training assistant. The assembly finds particular advantage for training softball pitchers and batters, although can be used to condition other dynamic training or therapeutic movements.

15 Claims, 4 Drawing Sheets

ATHLETIC TRAINING BELT

BACKGROUND OF THE INVENTION

The present invention relates to an athletic training aid and, and in particular, to a harness or belt which mounts about the hips or waist and thighs and cooperates with one or more training bands to control rotation of the user's hips and upper body when practicing softball pitching, batting or engaging in other athletic training or therapeutic movements.

A difficulty experienced by individuals who participate in the sport of fast pitch softball is that of learning proper hip and trunk rotation to achieve sufficient speed and control for optimal pitching and batting. Proper pitching motion requires a coordinated and controlled rotation of the arm, shoulder, wrist, hips and waist. The rotation of the body, particularly the waist and thighs is critical to achieving fast speeds. The motion, however, is somewhat unusual and not readily learned by mere repetition, unassisted instruction or through viewing video tapes.

A variety of training aids are known which can be fitted to selected body parts, for example, the legs, arms and waist and which can support weights or straps through which motion is either contained or controlled. Waist belts having looped fasteners mounted to the center of the belt and that receive an elastic strap are known for use in training runners, such as sprinters to develop improved thrust when leaving the starting blocks. Other training aids are known for assisting with the development of overhand pitching motion. Both of the foregoing aids control a defined, single line of motion. None of the foregoing assemblies provide a belt which mounts to the body and which belt is capable of preventing rotation of the belt during the application of training forces.

Various belts are also known for anchoring rock and wall climbers which provide waist and thigh straps. The thigh straps completely encircle each thigh. A single fastener is provided at the front and center of the belt. A belaying cleat mounts to the fastener and a rope is supported to the cleat. Other fasteners are not otherwise provided either at the belt or thigh straps to support other straps or ropes.

The present training assembly was developed to permit a coach or other trainer to selectively and dynamically manipulate or restrain a pitcher or batter while in motion. The restraint action does not interfere with the normal pitching or batting motion. The assembly securely mounts to the hips or upper body of a practicing pitcher or batter and selectively supports a number of resilient or static training straps to control and guide body motion without obstructing the motion. Selective forces can be simultaneously applied to the front, side or rear of the athlete without the belt rotating about the athlete, as the trainer pulls or anchors the training straps.

SUMMARY OF THE INVENTION

Accordingly, it is primary object of the invention to provide a training belt which mounts to the hips and supports a number of static or resilient training straps without rotating about the hips.

It is a further object of the invention to provide a length adjustable hip or body strap which includes a number of fasteners arrayed about the circumference of the hip strap and also includes length adjustable thigh straps which depend from the belt and mount around the thighs.

It is a further object of the invention to provide tubular elastomer training straps having a belt fastener and a handle secured to the strap with ball fittings secured within a bore of the strap.

Various of the foregoing objects, advantages and distinctions of the invention are obtained in a preferred construction which includes a hip strap and about the circumference of which a number triangular rings are fitted. The rings are secured to looped retainers that are sewn to a hip strap. Mating connecters are fitted to length adjustment straps which are also fastened to the hip straps and which also permit the hip strap to be mounted around the waist or upper body to train or condition other body motions.

Thigh straps are sewn at opposite sides of the waist strap. Mating fasteners are secured to the thigh straps to appropriately adjust the strap length to capture the thighs. Additional rings can be fitted to the thigh straps. The thigh straps prevent rotation of the hip strap about the hips upon pulling at one or more training straps that are fastened to the hip strap.

A resilient training strap is constructed of a length of rubber tubing and supports a clip fastener at one end that mounts to the rings and a handle at the opposite end. Ball shaped stoppers mount within the bore of the tubing to secure the clip fastener and handle to the training strap.

Still other objects, advantages, and distinctions of the invention are more apparent from the following description with respect to the appended drawings. The scope of the invention should not be literally construed to the following description, which is illustrative only of a presently preferred construction. Rather, the invention should be construed within the scope of the further appended claims.

DESCRIPTION OF THE PREFERRED EMBODIMENT

Figure 4:
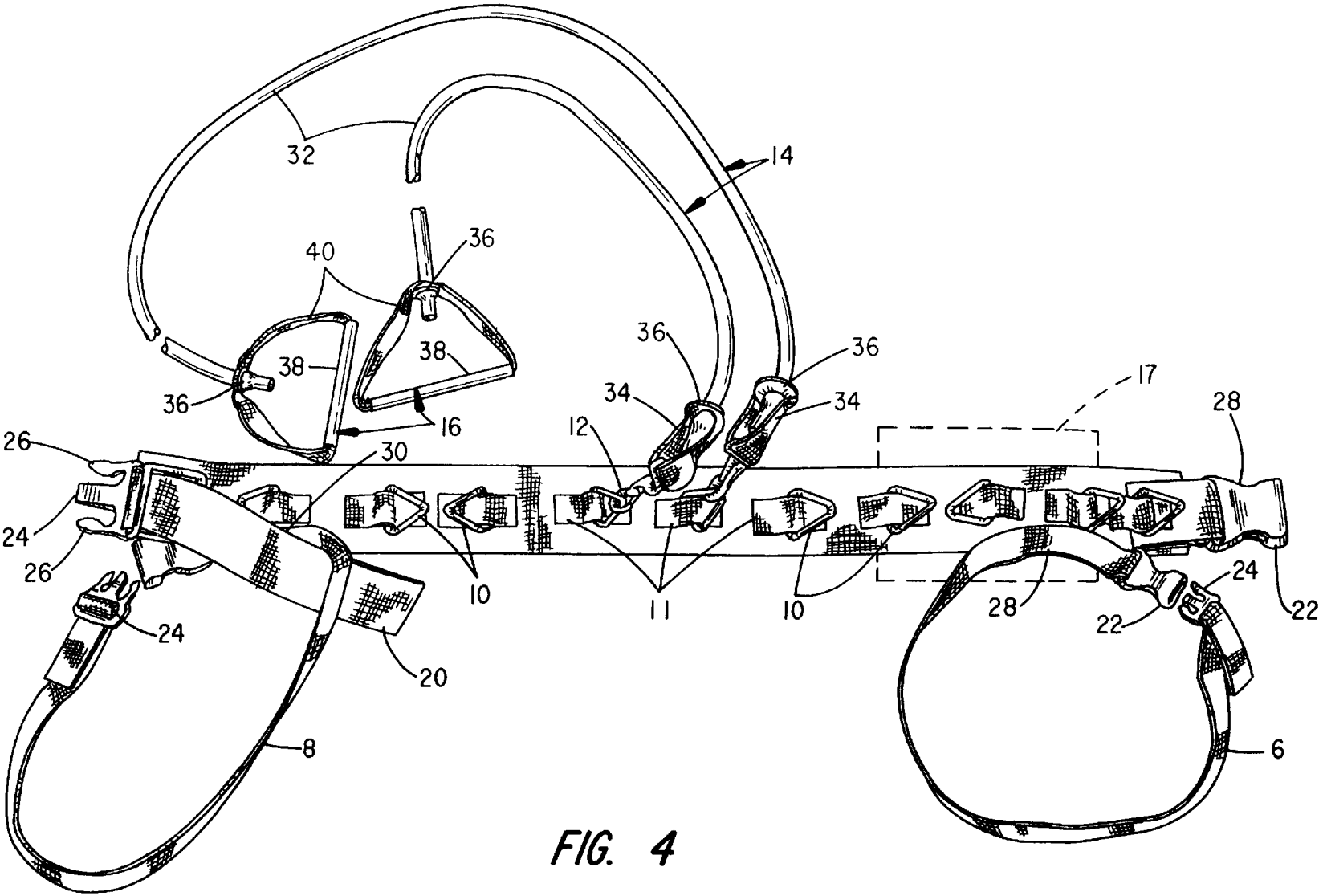
FIG. 4 is a plan view of the belt when removed and with a pair of strap retainers secured to the belt.

With attention to FIGS. of 1 through 3, exemplary views are shown to the belt 2 of the invention as it appears when worn by an athlete while practicing fast pitch softball motions. FIG. 4 depicts the belt 2 when removed in a plan view.

Figure 1:
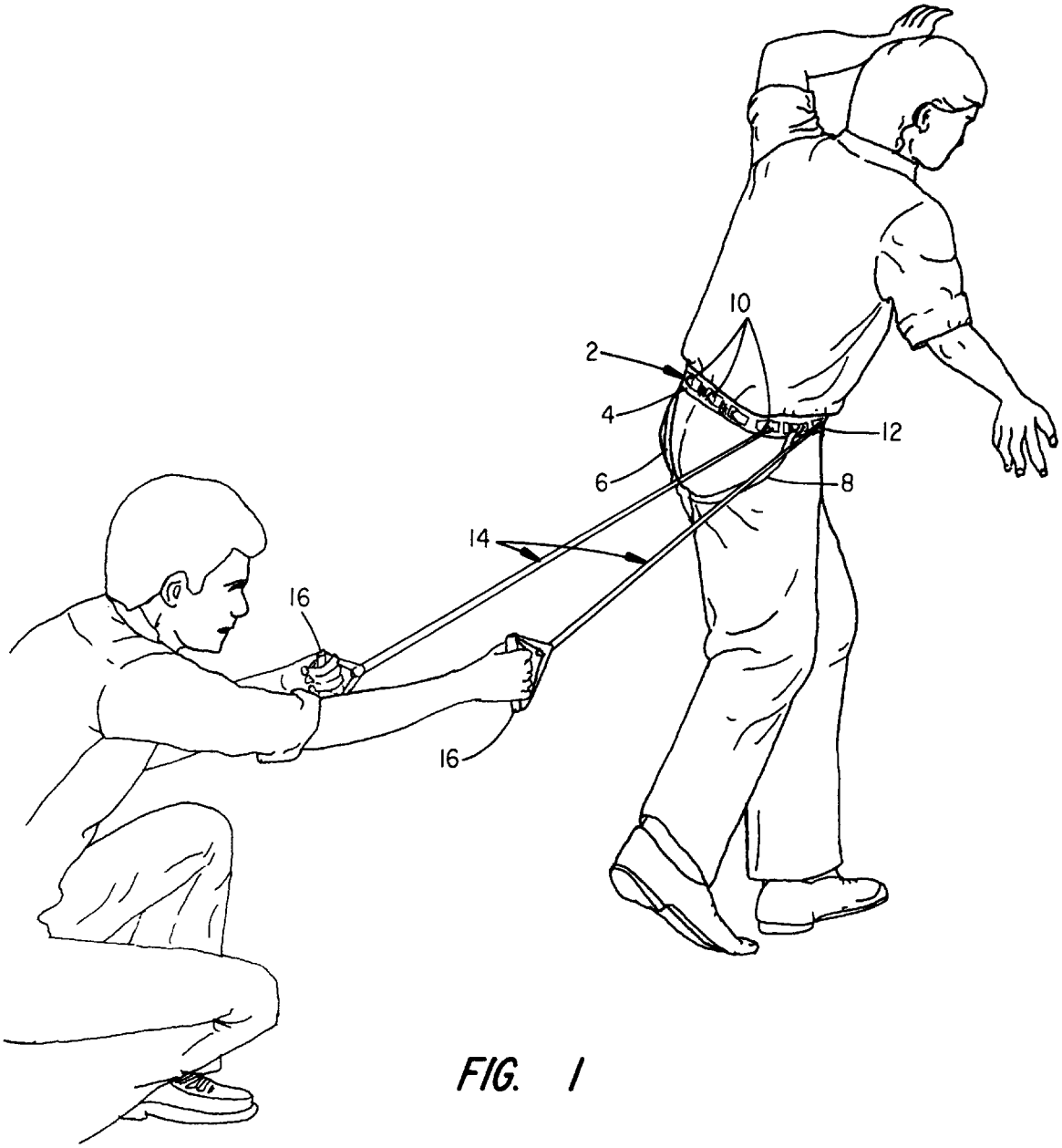
FIG. 1 is a perspective drawing of the training belt mounted to a pitcher and from which a pair of training straps depend.
Figure 2:
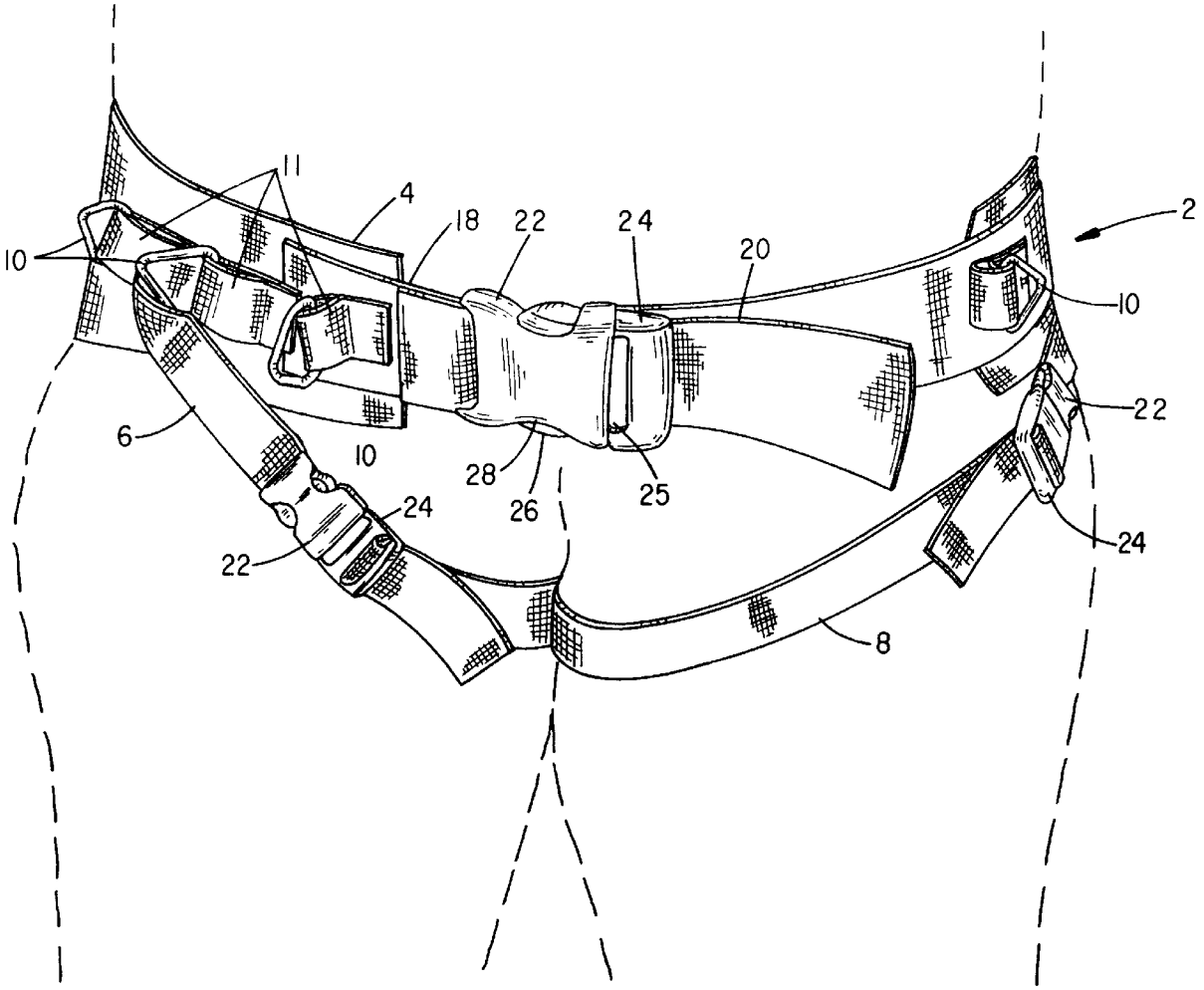
FIG. 2 is a front elevation view of the belt as it appears when mounted to a pitcher.

From FIG. 1, the belt 2 is normally secured beneath the waist and to partially surround each of the thighs. The belt 2 may also be mounted above the waist to the upper body. The belt 2 includes a hip or waist strap 4 and right and left thigh straps 6 and 8 which depend from the hip strap 4. The thigh straps 6 and 8 prevent the belt 2 from rotating during use, which can occur depending upon the forces placed on the belt 2 by the athlete or training assistant.

Arrayed around the circumference of the hip strap 4 are a number of triangular shaped rings 10. Secured to selected ones of the rings 10 are mating clip fasteners 12 at elastic training straps 14, reference FIG. 4. Handles 16 mounted to the opposite ends of each training strap 14 are held a training assistant or are secured to a suitable stationary support or anchor, a suitable distance from the athlete.

The hip strap 4 is constructed from a length of nylon webbing of an appropriate width. A 2 inch webbed material is presently used. Wider sections of webbing, for example 3 to 4 inch width sections, can be sewn to the strap 4 in the region of the outside surfaces of the hips to distribute the training forces without causing abrasion. The webbing is light weight and durable, can be easily sewn and can also be laundered.

Pads 17, one of which is shown in dashed line, may be permanently or temporarily mounted to the inside surface of the hip strap 4, as desired, in the region of the hips or other body locations to distribute the forces. Pads 17 are not presently required for pitching motions. The pads 17 can be constructed of a single material or can provide a cover and one or more cushioned inserts. The shape and thickness of each pad 17 can be tailored to fit the hips to prevent abrasion. Elastomer pads 17 can also be molded to a particularly preferred shape. The pads 17 can be temporarily or permanently secured to the belt 4 with VELCRO fasteners, rivets or the like, or loops can be provided at a cover piece to mount over the strap 4.

Fastened to the ends of the hip strap 4 are length adjustment straps 18 and 20. Mating buckles 22 and 24 are secured to the straps 18. The strap 20 is threaded through openings 25 in the body of the buckle 24. Resilient fingers 26 of the buckle 24 mount to recesses 28 of the buckle 22 to retain the buckles 22 and 24 to each other. Conventional plastic buckles 22 and 24 are presently used to secure the ends of the straps 18 and 20, although a variety of mating fasteners can be used.

The thigh straps 6 and 8 are constructed from lengths of nylon webbing selected in the range of ¾ to 1¼ inches in width. A 1 inch webbing is presently used. The straps 6 and 8 are sewn or otherwise fastened to the hip strap 4 at attachment points 28 and 30 in the region of the hips. Separate sets of smaller mating buckles 22 and 24 are secured to the ends of the straps 6 and 8 to permit length adjustment.

In normal use, the straps 6 and 8 are trained about the inside of the thighs to partially surround the thighs. Such a mounting prevents rotation of the hip strap 4, such as when the training straps 14 are mounted to apply an exaggerated force to one side or the other of the belt 2.

The ring fasteners 10 are presently mounted only to the hip strap 4, although might also be mounted to the thigh straps 6 and 8. Each ring 10 is retained by a nylon loop or tab 11 that is sewn to the hip strap 4. While rings 10 are presently preferred, other fasteners 10 can be used, provided they are compatible with the fasteners 12 at the training straps 14. Depending upon the type of fastener 10, tabs 11 or other suitable anchoring fasteners can be used to secure each fastener 10 to hip strap 4.

Figure 3:
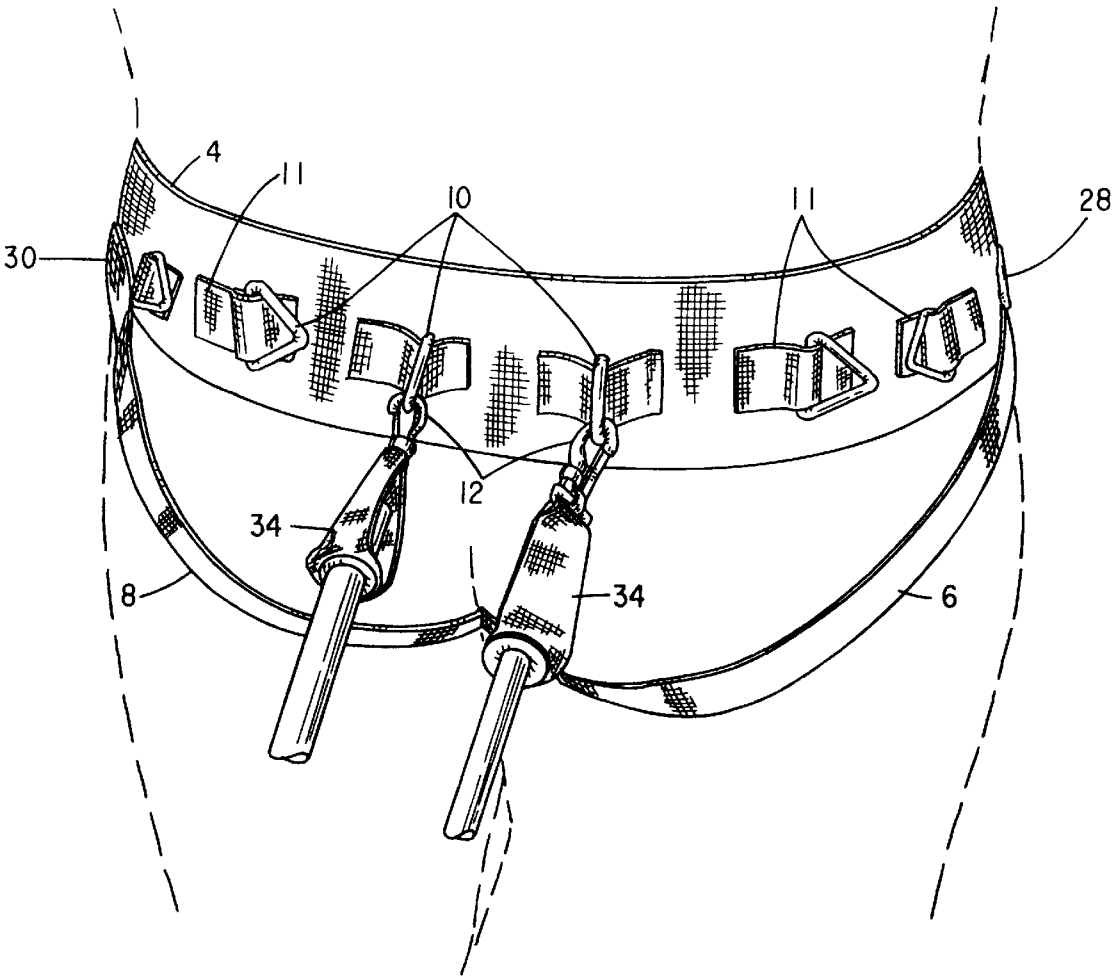
FIG. 3 is a rear elevation view of the belt as it appears mounted to a pitcher.

With attention to FIGS. 3 and 4 and the training straps 14, each training strap 14 is constructed of a length of elastomer tubing 32. The length, type of resilient material, durometer and diameter of the material can be selected to provide a desired tension or resistance to stretching. The straps 14 are sized to a preferred length, most typically 4 to 6 feet. The sizing is readily effected upon cutting the tubing to length and inserting a rubber ball stopper described below.

The clip fasteners 12 are secured to the straps 14 at sewn loops of webbing 34. A grommet 36 is fitted to the webbing 34 and the tubing 32 is threaded through the bore of the grommet 36. A ball shaped rubber stopper having a diameter larger than the bore of the grommet 36 is inserted with a suitable lubricant into the bore of the tubing 32. With the drying of the lubricant and the stretching of the tubing 32 during use, the stopper secures the fastener 12 to the training strap 14.

The handles 16 are constructed of a length of hard tubing 38. A loop of webbing 40 is fitted through the bore of the tube 38 and a grommet 36 is fitted to the loop 40. The tubing 32 is threaded through the grommet 36 and a ball stopper is mounted in the bore of the tubing 32. Although a presently preferred type of ring 10, clip fastener 12 and handle 16 are shown, it is to be appreciated, a variety of different fasteners 12 and handles 16 can be fitted to the training straps 14. For example, a presently preferred training strap used to train proper batting motion consists of a 50 to 60 inch strap having clip fasteners 12 secured to both ends.

The training straps 14 can also be constructed to be static or inelastic, such as by replacing the elastomer tubing 32 with a length of nylon webbing. The handles 16 might also be replaced with fasteners which mount to a variety of available stationary anchors, such as a fence or a ring which mounts to a pipe or a screw-in ground anchor. The type, number and mounting location of the training bands 14 that are mounted to the hip strap 4 will depend upon the body movement under focus. Preferably, the training straps 14 are constructed and positioned to most easily apply appropriate counter forces, which can occur from multiple directions, and which provide appropriate feedback to the athlete.

For example, upon performing the motions required to properly pitch a softball, the training straps 14 provide a counteracting force or resistance. The amount of dynamic resistance can be varied when the straps 14 are held by a training assistant or by the athlete standing a proper distance from a stationary anchor.

The resistance necessary to overcome the force of the straps 14 provides a positive feedback to the athlete. Over time, the athlete is able to distinguish the feedback tension and correct a defective portion of his or her form. Although resilient training straps 14 are presently preferred, static straps can also be used to advantage. A resilient strap, however, permits the athlete to perform a complete motion, with equal corrective forces being applied with each motion, provided the athlete maintains a constant distance from the anchor point of the straps 14.

While the invention has been described with respect to a presently preferred construction and variously considered alternative constructions, still others may be suggested to those skilled in the art. The invention should therefore be broadly construed within the spirit and scope of the appended claims to include all equivalent constructions.

What is claimed is:

1. A training harness comprising:

a) a hip strap including buckle means for fixing the length of the hip strap and attaching the hip strap about the torso and a plurality of attachment means arrayed about the circumference of said hip strap;

b) first and second thigh straps, wherein a portion of each of the first and second thigh straps is sewn to the hip strap at a surface of the hip strap that aligns to a lateral outside surface of the hips and such that each of the first and second thigh straps depend from the hip strap to mount around front and back surfaces of the thighs and extend beneath the crotch;

c) a training strap; and d) means for securing said training strap to a selected one of said attachment means, whereby a counter force can be applied to the torso to resist torso motion and without rotation of said hip strap.

2. A harness as set forth in claim 1 wherein said hip strap comprises a first length of webbing exhibiting a width greater than second and third lengths of webbing secured to opposite ends of said first webbing and wherein mating buckles are mounted along said second and third lengths of webbing.

3. A harness as set forth in claim 1 wherein each of said attachment means comprises a ring secured to the hip strap with a fabric loop.

4. A harness as set forth in claim 1 wherein said training strap comprises an elastomer member having a handle and a fastener which detachably mounts to said attachment means.

5. A harness as set forth in claim 1 wherein the portions of said first and second thigh straps that depend from the hip strap each include buckles and means for fixing the length of each of said first and second thigh straps.

6. A harness as set forth in claim 1 wherein said training strap comprises an elastomer tubing member having a handle and a fastener, wherein said handle and fastener are each secured to said tubing member at a loop containing a grommet and through which grommet said elastomer member is threaded, and wherein a stopper member is fitted in the bore of the tubing member.

7. A harness as set forth in claim 1 wherein said training strap comprises an inelastic member having a handle and a fastener.

8. A harness as set forth in claim 1 including a plurality of elastic and inelastic training straps secured to a plurality of the rings.

9. A harness as set forth in claim 1 including at least one cushioned pad fitted to said hip strap.

10. A training harness comprising:

a) a hip strap including first buckle means secured to opposite ends of the hip strap for fixing the length of the hip strap and attaching the hip strap about the torso and wherein a plurality of rings are secured about the circumference of the hip strap;

b) first and second thigh straps, wherein each of the first and second thigh straps has a pair of severed ends, wherein a portion of each of the first and second thigh straps intermediate the severed ends is sewn to the hip strap such that the severed ends depend from surfaces of the hip strap at lateral outside surfaces of the hips to mount around front and back surfaces of the thighs and beneath the crotch, and wherein third and fourth buckle means are secured to the severed ends of the first and second thigh straps for securing the severed ends together and fixing the length of the first and second thigh straps;

c) a training strap including means for securing said training strap to a selected one of said rings and having a handle to grip the training strap, whereby a counter force can be applied to the torso to resist torso motion and without rotation of the hip strap.

11. Apparatus as set forth in claim 10 wherein said hip strap comprises a first length of webbing exhibiting a greater width than second and third lengths of webbing secured to opposite ends of said first webbing and wherein mating buckles of said first buckle means are mounted along said second and third lengths of webbing.

12. A harness as set forth in claim 10 wherein said training strap comprises an elastomer tubing member having a handle and a fastener, wherein said handle and fastener are each secured to said tubing member at a loop containing a grommet and through which grommet said elastomer member is threaded, and wherein a stopper member is fitted in the bore of the tubing member.

13. A training harness comprising:

a) a hip strap including a first length of webbing exhibiting a greater width than second and third lengths of webbing secured to opposite ends of said first webbing and wherein mating buckles are adjustably mounted along said second and third lengths of webbing for fixing the length of the hip strap about the torso and a plurality of rings arrayed about the circumference of said hip strap;

b) first and second thigh straps each having a pair of severed ends, wherein a portion of each of the first and second thigh straps intermediate the severed ends is sewn to the hip strap such that the severed ends depend from surfaces of the hip strap at lateral outside surfaces of the hips and the first and second thigh straps to mount around front and back surfaces of the thighs and beneath the crotch, and wherein mating buckles are secured to the severed ends for securing the severed ends together and fixing the length of the first and second thigh straps;

c) an elastomer training strap including means for securing said training strap to a selected one of said rings and a handle, whereby a counter force can be applied to the torso to resist torso motion and without rotation of the hip strap.

14. A harness as set forth in claim 13 wherein said training strap comprises an elastomer tubing member having a handle and a fastener, wherein said handle and fastener are each secured to said tubing member at a loop containing a grommet and through which grommet said elastomer member is threaded, and wherein a stopper member is fitted in the bore of the tubing member.

15. A harness as set forth in claim 13 including at least one cushioned pad fitted to said hip strap.

* * * * *